US006589309B2

(12) United States Patent
Oh et al.

(10) Patent No.: US 6,589,309 B2
(45) Date of Patent: Jul. 8, 2003

(54) CYCLONE DUST COLLECTING ASSEMBLY FOR VACUUM CLEANER

(75) Inventors: Jang-keun Oh, Kwangju (KR); Jung-seon Park, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 10/028,403

(22) Filed: Dec. 21, 2001

(65) Prior Publication Data

US 2002/0092283 A1 Jul. 18, 2002

(30) Foreign Application Priority Data

Jan. 11, 2001 (KR) ..... 2001-1609

(51) Int. Cl.[7] ..... B01D 45/12
(52) U.S. Cl. ..... 55/429; 55/459.1; 55/DIG. 3
(58) Field of Search ..... 55/429, 459.1, 55/DIG. 3

(56) References Cited

U.S. PATENT DOCUMENTS 4,133,658 A * 1/1979 Callewyn ..... 55/315
4,172,710 A 10/1979 Van der Molen
6,146,434 A 11/2000 Scalfani et al.
6,428,589 B1 * 8/2002 Bair et al. ..... 55/318

FOREIGN PATENT DOCUMENTS

| | | |
|---|---|---|
| EP | 0928594 | 3/1998 |
| WO | WO9835602 | 8/1998 |
| WO | WO0074547 | 12/2000 |

* cited by examiner

*Primary Examiner*—Robert A. Hopkins
(74) *Attorney, Agent, or Firm*—Ladas & Parry

(57) ABSTRACT

A cyclone dust collecting assembly for a vacuum cleaner includes a dust barrel that is detachable from a cyclone body. The cyclone dust collecting assembly includes a cyclone body disposed in a dust chamber of a cleaner body, for separating by centrifugal force a contaminants from air that is drawn through a suction brush, a dust barrel removably connected to a lower end of the cyclone body. The dust barrel communicates with the cyclone body and collects the contaminants. The apparatus further includes a connecting/separating portion for removably connecting the dust barrel in the dust chamber to the lower end of the cyclone body.

14 Claims, 4 Drawing Sheets

CYCLONE DUST COLLECTING ASSEMBLY FOR VACUUM CLEANER

BACKGROUND OF THE INVENTION

1. Field of the Invention

The present invention relates to a cyclone dust collecting assembly for a vacuum cleaner, and more particularly to a cyclone dust collecting assembly having a separable dust barrel.

2. Description of the Related Art

Generally, a cyclone dust collecting apparatus for a vacuum cleaner directs air into a vortex. The cyclone dust collecting apparatus uses the centrifugal force of the vortex to separate contaminants from the air and collect the separated contaminants.

The cyclone dust collecting apparatus includes a cyclone body for directing the air that is drawn into the vacuum cleaner into a vortex and separating the contaminants from the air by centrifugal force. The cyclone dust collecting apparatus further includes a dust barrel for collecting the separated contaminants. The cyclone body and the dust barrel are integrally formed with each other. The cyclone dust collecting apparatus is received in a dust chamber of the vacuum cleaner. The dust barrel has a bottom plate formed on a lower end to be opened and closed. Accordingly, when the dust barrel is full of contaminants, the cyclone dust collecting apparatus is removed from a cleaner body in the vacuum cleaner. Then, the bottom plate is opened in order to dispose of the contaminants collected in the dust barrel.

The conventional cyclone dust collecting apparatus constructed as above, however, is inconvenient for a user to handle, since the user must remove the entire cyclone dust collecting apparatus from the cleaner body in order to empty the dust barrel mounted in the cyclone dust collecting apparatus.

SUMMARY OF THE INVENTION

The present invention has been made to overcome the above-mentioned problems of the related art. Accordingly, it is an object of the present invention to provide a cyclone dust collecting assembly for a vacuum cleaner having an improved structure, which is capable of connecting and separating a dust barrel to and from a cyclone body mounted in a cleaner body of the vacuum cleaner.

The above object is accomplished by a cyclone dust collecting assembly for a vacuum cleaner according to the present invention, including a cyclone body disposed in a dust chamber of a cleaner body. The cyclone body uses centrifugal force to separate contaminants from the air that is drawn in through a suction brush. The cyclone dust collecting assembly further includes a dust barrel removably connected to a lower end of the cyclone body, and a connecting separating portion for removably connecting the dust barrel to the lower end of the cyclone body in the dust chamber. The dust barrel is in communication with the cyclone body and collects those contaminants from the cyclone body that have been separated from the air by centrifugal force.

The connecting/separating portion includes a movable unit movably disposed on a lower side of the dust barrel in a reciprocal manner, for raising and lowering the dust barrel. The movable unit is received in and moves along a slanted recess formed in a lower end of the dust barrel. The connecting/separating portion further includes a base for movably supporting the movable unit from a lower portion of the dust chamber.

Further, it is preferable that the slanted recess spirals outward from a center to an outer edge of the dust barrel, gradually increasing in depth as it extends toward the outer edge.

The movable unit includes a movable lever disposed between the base and the dust barrel. The movable lever has a protrusion that is inserted into and guided along the slanted recess, a rotary pin formed on one end of the movable lever for rotatably supporting the movable lever to the base, and a handle formed on the other end of the movable lever and exposed to the outside of the dust chamber.

It is preferable that the movable lever, the rotary pin, and the handle are integrally formed with each other.

It is also preferable that the protrusion, which is formed on the movable lever, is offset from a middle line or main axis of the movable lever.

It is also preferable that the base is integrally formed in the cleaner body.

It is also preferable that the dust barrel has a handle formed on an outer surface thereof.

BRIEF DESCRIPTION OF THE DRAWINGS

The above objects and other features and advantages of the present invention will be clarified by the following description when read in conjunction with the attached drawings, in which.

DETAILED DESCRIPTION OF THE PREFERRED EMBODIMENT

This invention will be described in further detail by way of example with reference to the attached drawings.

Figure 1:
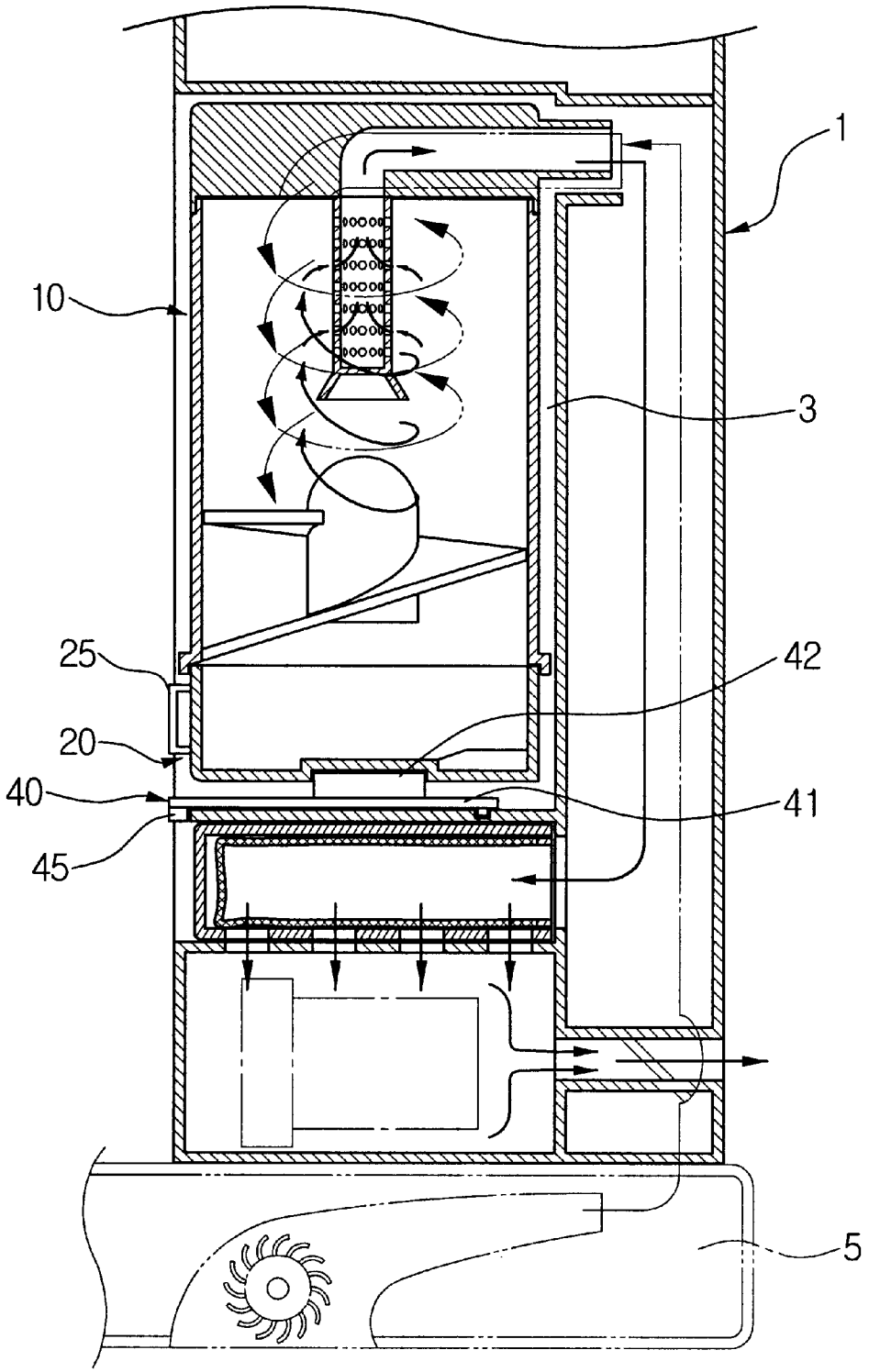
FIG. 1 is a sectional view of part of an upright type vacuum cleaner having a cyclone dust collecting assembly according to a preferred embodiment of the present invention.

Referring to FIG. 1, a vacuum cleaner includes a cleaner body 1 and a suction brush 5 coupled to the cleaner body 1. Within the cleaner body 1 the vacuum cleaner has a dust chamber 3 formed therein. The vacuum cleaner further includes a cyclone dust collecting assembly disposed in the dust chamber 3. The cyclone dust collecting assembly includes a cyclone body 10 mounted in the dust chamber 3, a dust barrel 20 removably mounted to a lower end of the cyclone body 10, and a connecting separating means 30.

The cyclone body 10 guides the air that is drawn through the suction brush 5 of the vacuum cleaner into a vortex and uses the centrifugal force of the vortex of air to separate contaminants from the air. The cyclone body 10 is disposed at an upper portion of the dust chamber 3.

The dust barrel 20, which is also mounted in the dust chamber 3, is detachable from the cyclone body 10. The dust barrel 20 has an open upper end. Accordingly, when the dust barrel 20 is connected to the cyclone body 10, the open upper end of the dust barrel 20 communicates with the cyclone body 10. Contaminants that have been separated from the air by centrifugal force, pass through the open upper end of the dust barrel 20 and are collected in the dust barrel 20.

Figure 2:
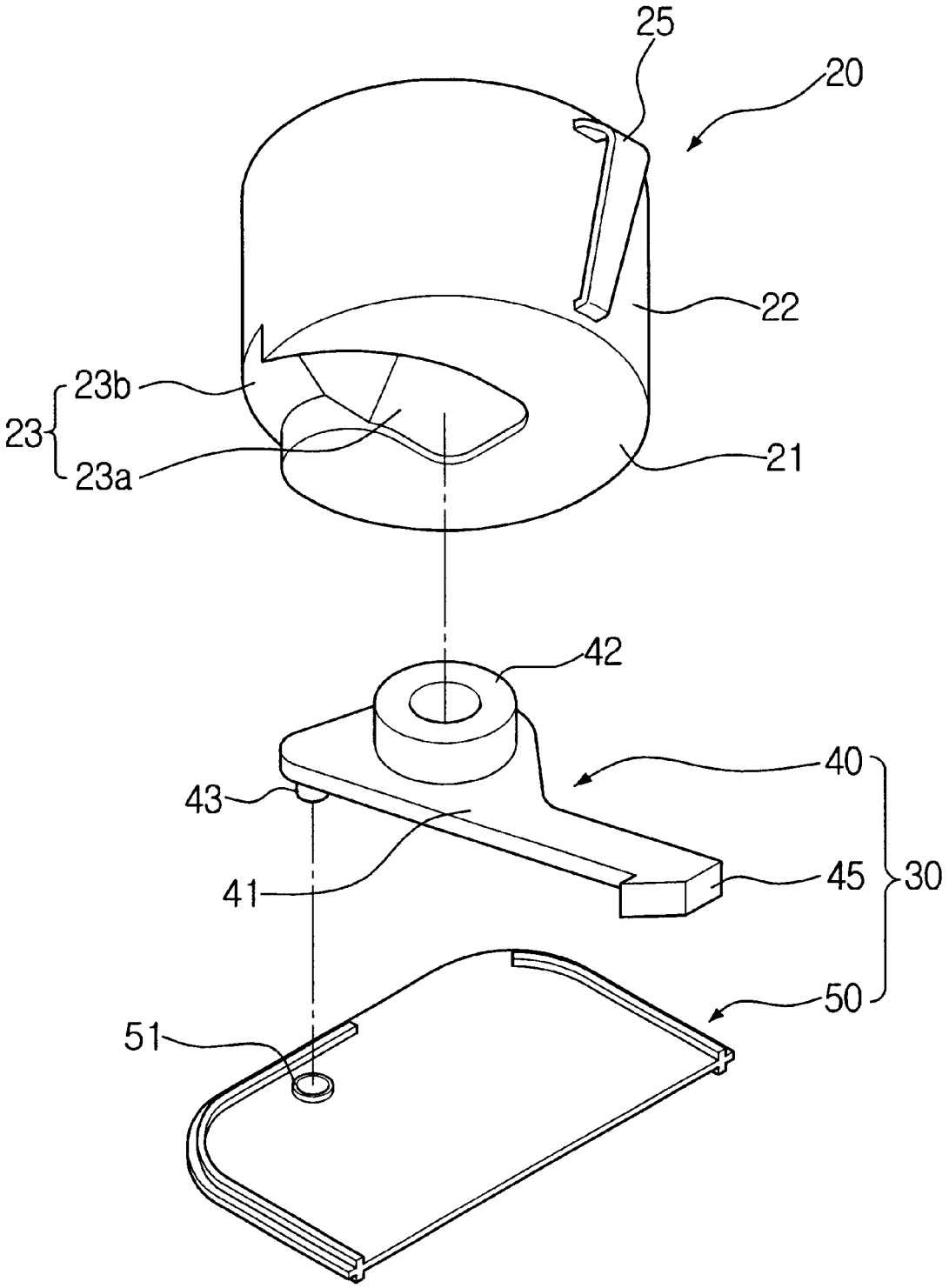
FIG. 2 is an exploded perspective view of the cyclone dust collecting assembly of FIG. 1.

As shown in FIG. 2, the dust barrel 20 has a closed bottom plate 21 and a cylindrical sidewall 22. The bottom plate 21 has a slanted recess 23 that is inclined to a predetermined depth. More specifically, the slanted recess 23 spirals outward, gradually increasing in depth, from a center of the bottom plate 21 to an outer edge of the bottom plate 21. Further, the slanted recess 23 has a center portion 23*a* that is recessed a predetermined depth and an outer edge portion 23*b* that is recessed a greater depth than the center portion 23*a*. It is preferable that the dust barrel 20 also includes a handle 25 formed on the sidewall 22.

The connecting/separating means 30 removably connects the dust barrel 20, which is mounted in the dust chamber 3, to the lower end of the cyclone body 10. The connecting/separating means 30 includes a movable unit 40 movably disposed on a lower side of the dust barrel 20 in a reciprocal manner, and a base 50 for supporting the movable unit 40 from a lower portion of the dust chamber 3.

The movable unit 40 includes a movable lever 41, a rotary pin 43 and a handle 45. The lever 41 is disposed between the base 50 and the dust barrel 20. The rotary pin 43 is disposed on one end of the movable lever 41, while the handle 45 is disposed on the other end. The movable lever 41 has a protrusion 42 that extends up from one side of the movable lever 41 by a predetermined height. The protrusion 42 is inserted into and guided along the slanted recess 23. The rotary pin 43, which is integrally formed with the movable lever 41, is inserted in a supporting hole 51 formed in the base 50. Accordingly, the rotary pin 43 pivotally supports the movable lever 41 on the base 50. That is, the movable lever 41 is reciprocally pivoted about the rotary pin 43. When the movable lever 41 is pivoted, the protrusion 42 moves along the slanted recess 23 to raise or lower the dust barrel 20.

The handle 45 is located along the front of the dust chamber 3 to facilitate a user's handling of the movable lever 41. The handle 45 is integrally formed with the movable lever 41. Further, the protrusion 42, which is formed on the movable lever 41, is offset from the middle line or main axis of the movable unit 41 and located closer to the rotary pin 43. By forming the protrusion 42 closer to the rotary pin 43, more moment value is exerted by the handle 45. Accordingly, less force is required to pivot the movable lever 41. Further, it is preferable that the protrusion 42 is formed in the shape of a cylinder so as to reduce any frictional force with the slant recess 23.

The base 50 is mounted on the lower side of the movable lever 41 and formed in the shape of a plate. Accordingly, the movable lever 41 pivots horizontally along an upper surface of the base 50. The base 50 may be integrally formed with the cleaner body 1. Also, the base 50 may be slidably disposed at the lower portion of the dust chamber 3.

The operation of the cyclone dust collecting assembly constructed as above according to the present invention will be described below.

Figure 3:
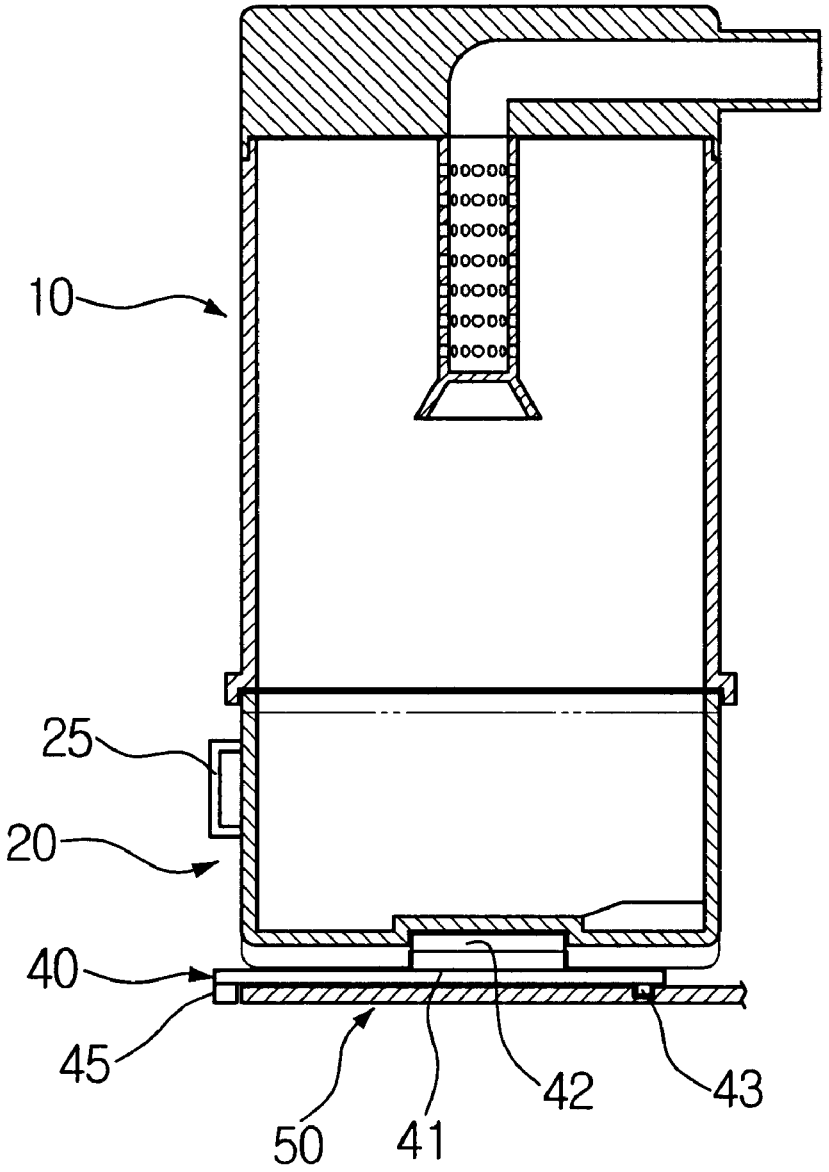
FIG. 3 is a sectional view of the cyclone dust collecting assembly of FIG. 2 in an assembled state.

FIG. 3 is a sectional view showing the cyclone body 10 and the dust barrel 20 of the cyclone dust collecting assembly in an assembled state. A dashed line shows the state of the cyclone dust collecting assembly when the dust barrel 20 is separated from the cyclone body 10.

Referring to FIG. 3, in the assembled state, the protrusion 42 of the movable lever 41 is positioned at the center portion 23*a* of the slanted recess 23, raising the dust barrel 20 into contact with the cyclone body 10. In this state, the handle 45 faces the forward direction of the dust chamber 3 (see FIG. 4A).

Figure 4A:
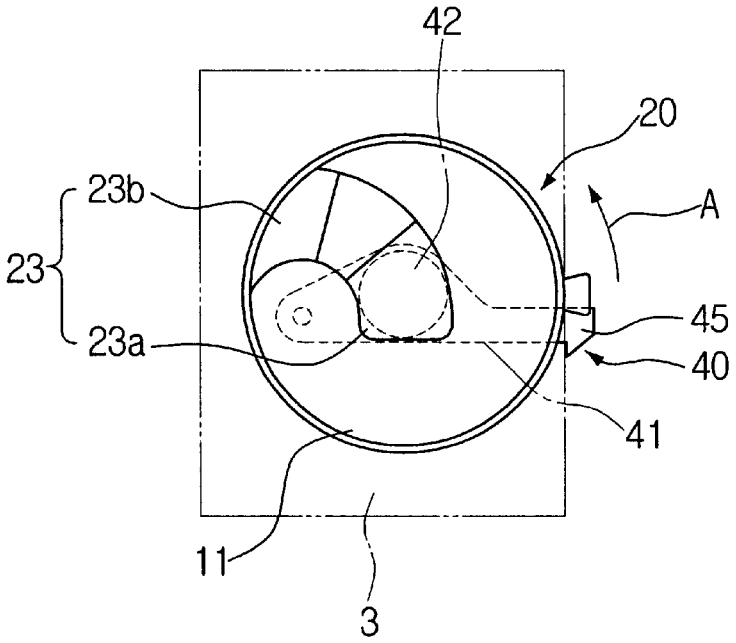
FIGS. 4A and 4B are plan views showing the operation of a locking unlocking means of the cyclone dust collecting assembly of FIG. 2.
Figure 4B:
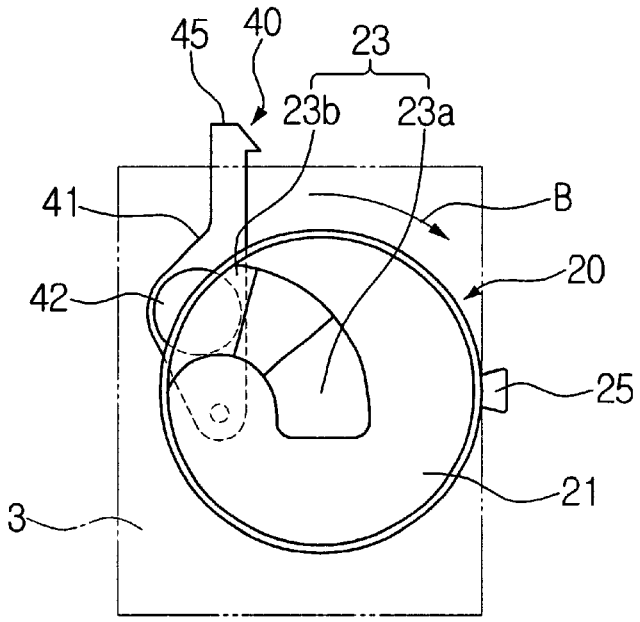

When the user grabs the handle 45 and pivots the movable lever 41 in a direction indicated by the arrow A, as shown in FIG. 4A, the protrusion 42 is moved along the slanted recess 23 to the outer edge portion 23*b* (see FIG. 4B). Accordingly, the dust barrel 20 is lowered to the position indicated by the dashed line in FIG. 3 and separated from the cyclone body 10. The user can then grab the handle 25 and pulls the dust barrel 20 forward, removing the dust barrel 20 from the dust chamber 3. The user then carries the dust barrel 20 over to a dustbin and empties the contents of the dust barrel 20 into the dustbin. As described above, in order to empty the dust barrel 20, the user detaches the dust barrel 20 from the cyclone body 10 and removes only the dust barrel 20 from the dust chamber 3. Accordingly, unlike the conventional dust collecting apparatus, in which the user must remove the entire apparatus, here, the detachable dust barrel 20 is easier to handle, since the user does not have to remove the entire cyclone dust collecting apparatus in order to empty the dust barrel 20.

Meanwhile, in order to re-insert the dust barrel 20 in the dust chamber 3, the user places the dust barrel 20 into the dust chamber 3 in a state that the movable lever 41 is positioned as shown in FIG. 4B. The protrusion 42 is positioned at the outer edge portion 23*b* of the slanted recess 23. As the user pivots the handle 45 in a direction indicated by the arrow B, the handle 45 returns to the state shown in FIG. 4A, and the protrusion 42 moves along the slanted recess 23 of the dust barrel 20 to the center portion 23*a*. Since the center portion 23*a* is recessed to a lesser depth than the outer circumference portion 23*b*, the dust barrel 20 is raised by the protrusion 42. Accordingly, the dust barrel 20 is pushed upward and connected to the lower end of the cyclone body 10 (see FIG. 1).

Once the dust barrel 20 is connected to the cyclone body 10 in the dust chamber 3, any separation of the dust barrel 20 from the cyclone body 10 is prevented, even when the user moves the vacuum cleaner during cleaning.

Although the cyclone dust collecting assembly is employed in the upright type vacuum cleaner in this embodiment, the cyclone dust collecting assembly may also be employed in a canister type vacuum cleaner.

Although the preferred embodiment of the present invention has been described, it will be understood by those skilled in the art that the present invention should not be limited to the described preferred embodiment. Various changes and modifications can be made within the spirit and scope of the present invention as defined by the appended claims.

What is claimed is:

1. A cyclone dust collecting assembly for a vacuum cleaner, comprising:

a cyclone body disposed in a dust chamber of a cleaner body, for separating by centrifugal force a contaminant from air that is drawn through a suction brush;

a dust barrel removably connected to a lower end of the cyclone body, for collecting the contaminant separated by centrifugal force; and connecting/separating means having a movable unit for removably connecting the dust barrel in the dust chamber to the lower end of the cyclone body by raising/lowering the dust barrel, wherein the movable unit reciprocates along a slanted recess formed in the dust barrel.

2. The cyclone dust collecting assembly of claim 1, wherein the slant recess is formed in a lower end of the dust barrel, and the connecting/separating means comprises a base for movably supporting movable unit from a lower portion of the dust chamber such that the movable unit is reciprocated along the slanted recess.

3. The cyclone dust collecting assembly of claim 2, wherein the slanted recess spirals outward from a center to an outer edge of the dust barrel, the slanted recess gradually increasing in depth as it extends toward the outer edge.

4. The cyclone dust collecting assembly of claim 2, wherein the movable unit comprises:

a movable lever disposed between the base and the dust barrel, the movable lever having a protrusion, the protrusion being received in and guided along the slant recess;

a pin formed on one end of the movable lever, for rotatably supporting the movable lever on the base; and a handle formed on the other end of the movable lever and extending outside of the dust chamber.

5. The cyclone dust collecting assembly of claim 4, wherein the movable lever, the rotary pin, and the handle are integrally formed with each other.

6. The cyclone dust collecting assembly of claim 4, wherein the protrusion is formed on the movable lever and offset from a middle line of the movable lever.

7. The cyclone dust collecting assembly of claim 2, wherein the base is integrally formed in the cleaner body.

8. The cyclone dust collecting assembly of claim 1, wherein the dust barrel has a handle formed on an outer wall thereof.

9. A cyclone dust collecting assembly for a vacuum cleaner having a suction brush and a dust chamber, the cyclone dust collecting assembly comprising:

a cyclone body disposed in the dust chamber, the cyclone body separating contaminants from air that is drawn in through the suction brush;

a dust barrel removably connected to a lower end of the cyclone body, the dust barrel collecting the contaminants, the dust barrel including a bottom plate having a recess formed therein; and a movable unit for raising and lowering the dust barrel into contact with the cyclone body, the movable unit including a protrusion, the protrusion being received in the recess of the bottom plate.

10. The cyclone dust collecting assembly of claim 9, wherein the recess spirals outward and gradually increases in depth from a center of the bottom plate to an outer circumference of the dust barrel.

11. The cyclone dust collecting assembly of claim 9, wherein the movable unit includes a lever having a first and a second end, a pin located proximate the first end, and a handle located at the second end, and further comprising a base pivotally supporting the movable unit, the base having a supporting hole for receiving the pin.

12. The cyclone dust collecting assembly of claim 11, wherein the lever, the pin and the handle of the movable unit are integrally formed.

13. The cyclone dust collecting assembly of claim 11, wherein a center of the protrusion is offset from a main axis of the movable unit.

14. The cyclone dust collecting assembly of claim 9, wherein the dust barrel has a handle formed on an outer wall thereof.

* * * * *